US005683814A

United States Patent [19]

Kakita et al.

[11] Patent Number: 5,683,814

[45] Date of Patent: *Nov. 4, 1997

[54] MODIFIED CROSS-SECTION FIBER FOR ARTIFICIAL HAIR

[75] Inventors: Naohiko Kakita, Kobe; Kenichiro Cho, Takasago; Hiroyuki Nakashima, Kakogawa; Nobuyuki Nishi, Takasago; Koichi Nishiura, Akashi, all of Japan

[73] Assignee: Kanegafuchi Kagaku Kogyo Kabushiki Kaisha, Osaka, Japan

[ * ] Notice: The term of this patent shall not extend beyond the expiration date of Pat. No. 5,677,059.

[21] Appl. No.: 624,357

[22] Filed: Apr. 11, 1996

[30] Foreign Application Priority Data

Apr. 28, 1995 [JP] Japan ..... 7-106149

[51] Int. Cl.[6] ..... D02G 3/00

[52] U.S. Cl. ..... 428/401; 428/397; 428/364

[58] Field of Search ..... 428/376, 364, 428/397, 401; 132/201, 200; 57/4

[56] References Cited

U.S. PATENT DOCUMENTS 3,238,553 3/1966 Bailey et al. ..... 428/397

3,746,827 7/1973 Martin et al. ..... 428/397

3,910,291 10/1975 Kim ..... 428/397

FOREIGN PATENT DOCUMENTS 3145409 6/1988 Japan .

*Primary Examiner*—Newton Edwards

*Attorney, Agent, or Firm*—Armstrong, Westerman, Hattori, McLeland & Naughton

[57] ABSTRACT

Modified cross-section fibers for artificial hair having an improved bulkiness and a soft feeling as compared with conventional fibers for the artificial hair, comprising synthetic fibers, the synthetic fiber having a cross-section comprising one central connecting portion and projections extended in three directions from the central connecting portions, wherein at least one of the three projections is most narrowed at a portion where it is nearer from a top edge of the projection than ½ of a length R from a center of the central connecting portion to the top edge of the projection, a ratio of W1/W2 wherein W1 is a width of the widest portion in a portion where it is nearer from the top edge than the most narrowed portion, and W2 is a width of the most narrowed portion is 1.05 to 2.0, and a ratio of R/W1 wherein R and W1 are the same as defined above is from 1.10 to 5.0.

6 Claims, 2 Drawing Sheets

MODIFIED CROSS-SECTION FIBER FOR ARTIFICIAL HAIR

FIELD OF THE INVENTION

The present invention relates to a modified cross-section fiber for artificial hair having a soft feeling and an excellent bulkiness, which can be used for the decoration of hair such as braid, extension hair, and the like.

BACKGROUND OF THE INVENTION

In general, as synthetic fibers to be used for artificial hair, modacrylic fibers, vinyl chloride fibers, vinylidene chloride fibers, polyester fibers, nylon fibers, and the like are known. Conventionally, when articles for artificial hair such as wigs or hair pieces are formed using those fibers, the cross sectional shape of the fibers that meet its commercial value has been investigated, and the improvement has been made on this point. For example, JP-A-55-76102 proposes to exhibit properties near the human hair by employing the fiber having a cross-section such as an approximately star shape or cocoon shape, and JP-U-A-58-65316 proposes the fiber which is applicable to a wide range of styles by using fiber having a hollow cross-section which is constituted by 3 to 6 T-shaped projections which are radially arranged from the central portion of the fiber. (The term "JP-A" used herein means an "Japanese unexamined Patent Publications", and the term "JP-U-A" used herein means an "Japanese unexamined Utility Model Publication".). In general, when the fiber having a substantially circular cross-sectional shape is used, the use of such fiber is suitable to obtain a soft feeling, or for straight hair style, but is not suitable for decorative articles for hair on the head such as braid which is required to have a bulkiness.

As a result of intensive study on fibers for hair to obtain decorative articles for hair on the head such as a braid which is rich in the bulkiness, the present inventors succeeded to develop the fiber that improved the bulkiness by improving the cross-section of the fiber, and disclosed the technology in JP-U-A-56-42980. It is sure that by employing a fiber forming three-forked Y shape cross-section, a bulkiness to a certain extent may be obtained. However, it involves a problem that the portion projecting from the central portion has an approximately rectangular shape, fibers having slightly rigid feeling are obtained, and when a wet spinning method is employed as in, for example, acrylic fibers, it is technically difficult to obtain a cross-section of the rectangular shape.

SUMMARY OF THE INVENTION

Accordingly, an object of the present invention is to provide a modified cross-section fiber for artificial hair which has an improved bulkiness and can give a soft feeling.

In order to achieve the above object, as a result of extensive study on various cross-sections of the fiber for artificial hair comprising synthetic fiber, it has been found that the bulkiness can be improved, as compared with the prior art, and the soft feeling can be imparted by employing the following cross-section. That cross-section comprises one central connecting portion and projections extended in three directions from the central connecting portion, wherein at least one of the three projections is most narrowed at a portion where it is nearer from a top edge of the projection than ½ of R, which is a length from a center of the central connecting portion to the top edge of the projection. Further, a ratio of W1/W2, wherein W1 is a width of the widest portion in a portion where it is nearer from the top edge of the projection than the most narrowed portion, and W2 is a width of the most narrowed portion, is fallen within the specified range, and a ratio of R/W1, wherein R and W1 are defined in the same manner above, is fallen within the specified range. The present invention has been completed based on this finding.

The modified cross-section fibers for artificial hair according to the present invention comprise synthetic fibers, the fiber having a cross-section comprising one central connecting portion and projections extended in three directions from the central portion, wherein at least one of three projections is most narrowed at a portion where it is nearer from the top edge of the projection than ½ of R, which is a length of from a center of the central connecting portion to the edge portion of the projection, a ratio of W1/W2, wherein W1 is a width of the widest portion in a portion where it is nearer from the top edge than the most narrowed portion and W2 is a width of the most narrowed portion is fallen within a range of from 1.05 to 2.0, and a ratio of R/W1, wherein R and W1 are defined in the same manner above, is fallen within a range of from 1.10 to 5.0.

DETAILED DESCRIPTION OF THE INVENTION

The present invention is described in detail below.

Figure 1:
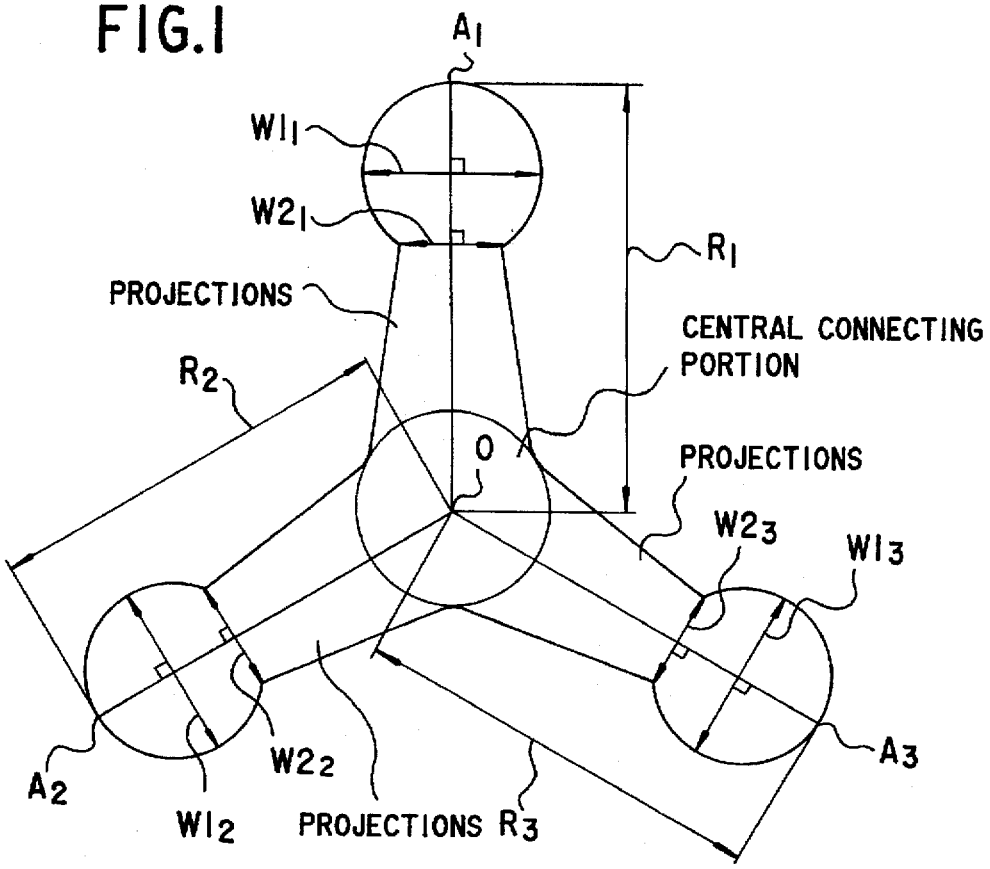
FIG. 1 is a view explaining dimensions in a cross-section of a fiber according to the present invention.

The center of the central connecting portion in the fiber cross-section in the present invention is a center O of an inscribed circle of the central connecting portion in the fiber cross-section, and the top edges of the projections are points A1 to A3 in the three projections which are the farthest from the center O of the central connecting portion, as shown in FIG. 1. Further, in FIG. 1, W1 is a width of the widest portion in the portion where it is nearer from the top edge than the most narrowed portion in each projection, and is shown by $W1_1$ to $W1_3$ which are a width in each portion in a direction crossing a line connecting the center O in the central connecting portion and the top edges A1 to A3 in each projection, and W2 is a width of the most narrowed portion, and is shown by $W2_1$ to $W2_3$ which are a width in each portion in a direction crossing a line connecting the center 0 and the top edges A1 to A3 in each projection.

It is preferred in the present invention that at least two of three projections are most narrowed at the portions where they are nearer the top edges than ½ of R which is the length from the center of the central connecting portion to the top edge of the projection, a ratio of W1 max/W1 min wherein W1 max is the maximum value of the width W1 of the widest portion in the portion from the most narrowed portion to the edge-near portion, and W1 min is the minimum value of the width W1 in the portion from the most narrowed portion to the edge-near portion is within a range from 1.05 to 1.7, and a ratio of R max/R min wherein R max is a maximum value of the length R from the center of the connecting portion to the top edge of each projection, and R min is a minimum value of the length R from the center of the connecting portion to the top edge of each projection is within a range of from 1.05 to 1.5.

The maximum value W1 max and the minimum value W1 min in the width W1 of the widest portion in the portion of from the most narrowed portion to the edge-near portion in the projections are the maximum value and the minimum value, respectively, in, for example, the widths $W1_1$ to $W1_3$ of the widest portion in the portion from the most narrowed portion to the edge-near portion in the projection, and the maximum value R max and the minimum value R min of the length R from the center of the central connecting portion to the top edge of the projection are the maximum value and the minimum value, respectively, in the lengths R1 to R3 of from the center O of the central connecting portion to the top edges A1 to A3 in each projection.

The synthetic fiber that constitutes the fiber for artificial hair according to the present invention is not particularly limited, but examples thereof generally include modacrylic fibers, vinyl chloride fibers, vinylidene chloride fibers, polyester fibers, polyamide fibers, and polyolefin fibers. Of those fibers, to obtain the desired articles having a soft feeling and a bulkiness, modacrylic fibers and vinyl chloride fibers, having a relatively low Young's modulus are preferred in processability for imparting crimps and also in the soft feeling, and modacrylic fibers having a small polymer specific gravity are more preferred in the point of bulkiness. Polyolefin fibers such as polypropylene show rigid feeling due to high strength. Further, where synthetic fibers are used as decoration for hair on the head, it is strongly desired for the fibers to be flame retardant on the purpose of the use of articles. For those reasons, the polyolefin fibers which are flammable may have undesirable properties, but are excellent in the specific gravity of polymer, and if the cross-section according to the present invention is applied to the polyolefin fibers, fibers for hair having a bulkiness can be obtained.

In producing the fiber for artificial hair according to the present invention, spinning nozzles used are appropriately selected depending on the spinning method, the type of polymer used, and the like. For example, where a melt spinning method or a dry spinning method is employed, it is desirable to use spinning nozzles having a hole shape approximately near the cross-section of the fibers which are purposed in the present invention. The same embodiment as above can be applied to the production of the fibers where a wet spinning method is employed. However, where a wet spinning method is employed to produce modacrylic fibers, it is not always required for the spinning nozzles to have a hole shape entirely corresponding to the cross-section of the desired fibers. Even if nozzles having a hole shape which does not have a narrowed portion in the projections extended from the central connecting portion is employed, if spinning draft is increased to about 1.5 to 2.0, fibers having the desired cross-section can be obtained.

An appropriate range of fineness of single yarn in the fibers for artificial hair according to the present invention varies depending on materials of polymer. As a result of investigations in view of the fineness of human hair, the fineness of single yarn in the fibers is preferably from 25 to 75 denier. Further, in order to emphasize a soft feeling, the fineness is more preferably from 25 to 40 denier. If the fineness exceeds 75 denier, stiffness of the fibers increases. As a result, it is sometimes difficult to process the fibers into articles such as braid, and the feeling of the fibers may become unnatural. On the other hand, if the fineness of single yarn is less than 25 denier, there is a problem that the single yarn is too soft, so that the bulkiness of the fibers is poor. Thus, it is important to select an appropriate fineness of single yarn.

It is necessary in the cross-sectional shape of the fibers according to the present invention that W1/W2 ratio is from 1.05 to 2.0, and preferably from 1.05 to 1.5, and R/W1 ratio is from 1.10 to 5.0, and preferably from 2.0 to 4.0. If the W1/W2 ratio is less than 1.05, the fibers tend to cleave in post-treatments such as crimping, and on the other hand, if the W1/W2 ratio is larger than 2.0, a problem arises that since balance in the whole size of the cross-section is destroyed, and the width W2 in the most narrowed portion becomes too narrow, the fiber tends to cleave at the stage of the production thereof. Thus, the bulkiness purposed cannot be attained. Further, if the R/W1 ratio is less than 1.10, an area effect as the projection is lost, whereas, if the R/W1 ratio is larger than 5.0, the width W1 in the projection becomes too narrow, so that the fiber is bent and the effect for the bulkiness cannot be exhibited. Thus, the bulkiness purposed cannot be attained.

When the fiber for artificial hair according to the present invention is used as decoration for hair on the head such as braids or extension hairs, fiber bundle of an approximately wavy shape are, in many cases, formed by subjecting the fiber to crimping such as gear crimping. It is preferred that the crimping is conducted to impart 5 to 15 wavy shapes as a repeating unit of a crest and a root to the linear distance of 100 mm of the fiber bundle. Further, it is preferred that the total length of the height of the crest and a depth of the root is 5 to 12 mm.

The present invention is described in more detail by reference to the following examples, but it should be understood that the invention is not construed as being limited thereto. Unless otherwise indicated, denier is represented by "d" for brevity.

EXAMPLE 1

Figure 2:
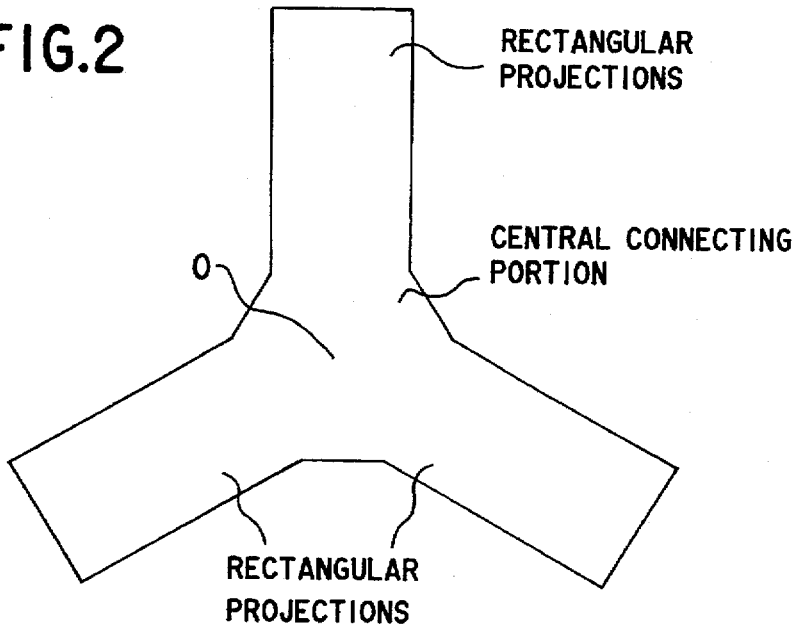
FIG. 2 is a cross-sectional view showing a shape of a nozzle hole for obtaining fibers in Example 1.

A copolymer resin comprising 49% by weight of acrylonitrile, 50% by weight of vinyl chloride, and 1% by weight of sodium stryrenesulfonate were dissolved in acetone to prepare a 28% by weight of spinning solution. This spinning solution was spun into a 30% by weight of acetone aqueous solution through approximately Y-shaped spinning nozzles having rectangular projections extended in three directions from a central connecting portion as shown in FIG. 2. A spinning draft at that time was 1.7. The fibers thus obtained were subjected to stretching of 2 times under the condition that the solvent remained in the fibers, dried at 120° C., subjected to heat stretching of 2.5 times, and then subjected to dry heat treatment at a temperature higher than the temperature at the drying. The fibers thus obtained had a cross-section comprising one central connecting portion and projections extended in three directions from the central connecting portion, wherein at least one of three projections is most narrowed at a portion where it is nearer from a top edge of the projection than ½ of a length from a center of the central connecting portion to the top edge of the projection. Fineness of the single yarn of the fibers was 32 d. Dimensions of this fiber are shown in the Table below.

The fiber thus obtained was subjected to gear crimping such that the linear distance of 100 mm of the fiber had 10 repeating units of a crest and a root, on the average, and the total length of the height of the crest and the depth of the root was 7 mm on the average, thereby forming an approximately wavy bundle. Using this bundle, three bundle-knitted article of 5 g×30 corrugations (regular size) which was the representative braid was prepared, and functional evaluations were performed on the bulkiness and the soft feeling as the braid.

The results obtained are shown in the Table below.

COMPARATIVE EXAMPLE 1

The same copolymer resin as used in Example 1 was dissolved in acetone to prepare a 28 wt % spinning solution. This spinning solution was spun in a 30 wt % acetone aqueous solution through spinning nozzles having a cross-section of a nozzle hole as shown in FIG. 2. The spinning draft at that time was 1.2. The fibers thus obtained were subjected to drying, stretching and heat treatment in the same manners as in Example 1. The fibers thus obtained had a cross-section comprising one central connecting portion and projections extended in three directions from the central connecting portion, wherein at least one of three projections was most narrowed at a portion where it was nearer from the top edge of the projection than ½ of a length of from a center of the central connecting portion to the top edge of the projection. Fineness of the single yarn of the fibers was 45 d. The dimensions of the cross-section of the fiber are shown in the Table below. Further, the functional evaluations were performed on the bulkiness and the soft feeling in the same manners as in Example 1.

The results obtained are shown in the Table below.

COMPARATIVE EXAMPLE 2

The same copolymer resin as used in Example 1 above was dissolved in acetone to prepare a 28 wt % spinning solution. This spinning solution was spun into a 30 wt % acetone aqueous solution through circular (0.3 mm diameter) spinning nozzles. A seining draft at that time was 1.2. The fibers thus obtained were subjected to drying, stretching and heat treatment in the same manners as in Example 1. A cross-section of the fibers thus obtained is shown in the Table below. Further, functional evaluations were performed on the bulkiness and the soft feeling as the braid in the same manners as in Example 1.

The results obtained are shown in the Table below. The fiber had a cross-section of nearly flatten shape, and did not have the bulkiness.

EXAMPLE 2

Figure 3:
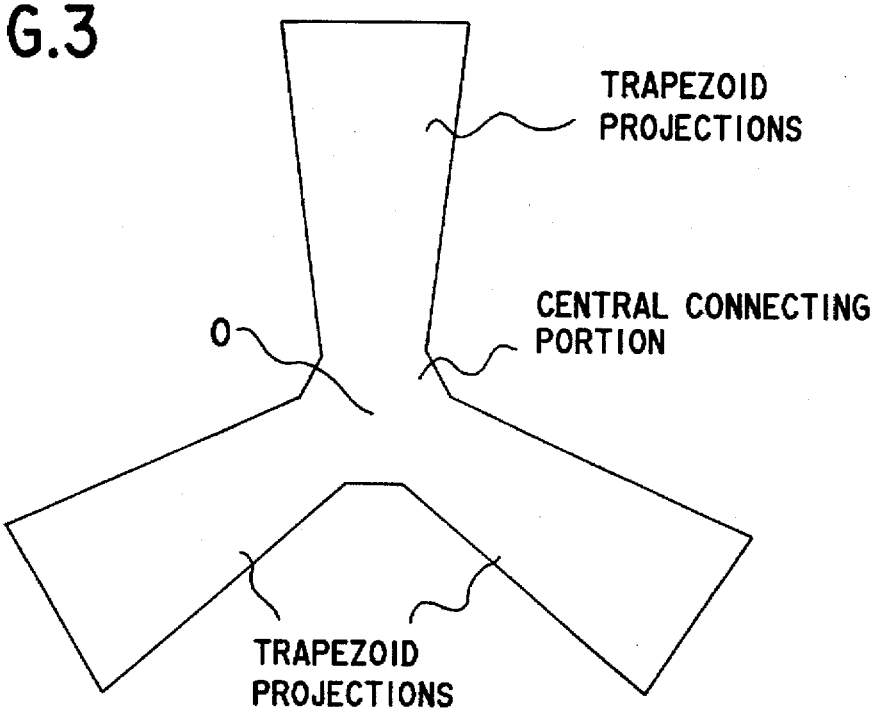
FIG. 3 is a cross-sectional view showing a shape of a nozzle hole for obtaining fibers in Examples 2 and 3.

The same copolymer resin as used in Example 1 was dissolved in acetone to prepare a 28 wt % spinning solution. This spinning solution was spun into a 30 wt % acetone aqueous solution through spinning nozzles having three trapezoid projections which widened toward a top edge of the respective projections as shown in FIG. 3. A spinning draft at that time was 1.2. The fibers thus obtained were subjected to drying, stretching, and heat treatment in the same manner as in Example 1. The fiber thus obtained had a cross-section comprising one central connecting portion and three projections extended in three directions from the central connecting portion, wherein at least one of the three directions was most narrowed at a portion where it was nearer from the top edge of the projection than ½ of a length of from a center of the central connecting portion to the top edge of the projection. Fineness of the single yarn of the fiber was 32 d. Dimensions of cross-section of the fiber were shown the Table below.

Further, functional evaluations were performed on the bulkiness and the soft feeling as the braid in the same manner as in Example 1.

The results obtained are shown in the Table below. In this case, the spinning draft was low, but by making improvement on the nozzles, the desired cross-section of fibers could be obtained.

EXAMPLE 3

The same copolymer resin was dissolved in acetone to prepare a 28 wt % spinning solution. This spinning solution was spun into a 30 wt % acetone aqueous solution through the spinning nozzles as shown in FIG. 3. A spinning draft at that time was 1.7. The fibers thus obtained were subjected to drying, stretching and heat treatment in the same manner as in Example 1. The fiber thus obtained had a cross-section comprising one central connecting portion and projections extended in three directions from the central connecting portion, wherein at least one of the three projection was most narrowed at a portion where it was nearer from the top edge of the projection than ½ of a length of from a center of the central connecting portion to the top edge of the projection. Fineness of single yarn of the fiber was 32 d. Dimensions of a cross-section of the fiber obtained are shown in the Table below.

Further, functional evaluations were performed on the bulkiness and the soft feeling as the braid in the same manner as in Example 1.

The results obtained are shown in the Table below.

EXAMPLE 4

Figure 4:
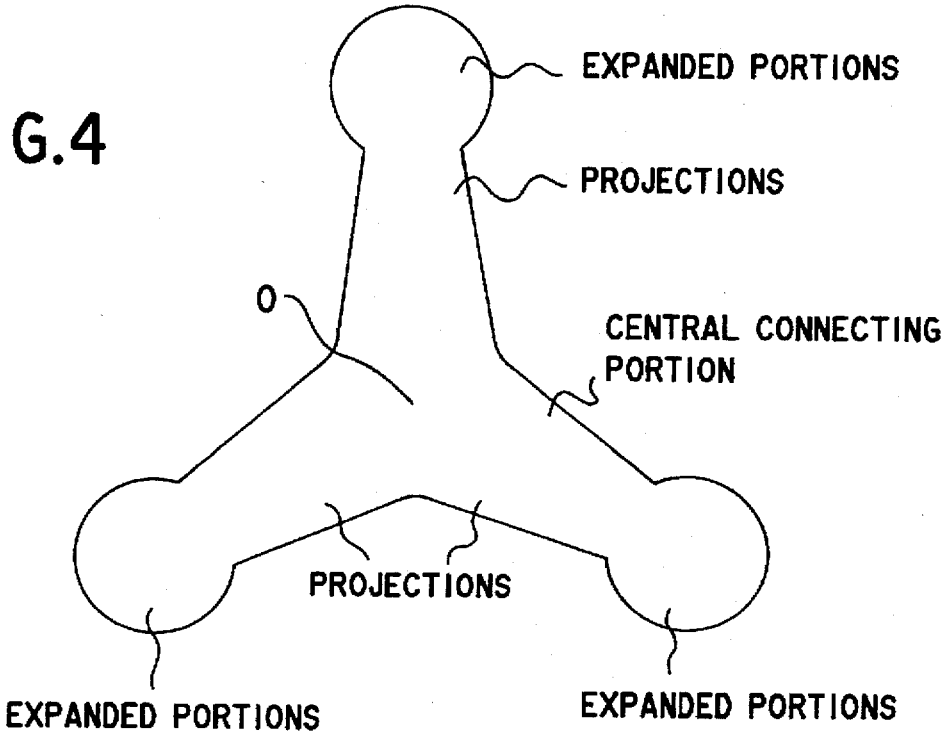
FIG. 4 is a cross-sectional view showing a shape of a nozzle hole for obtaining fibers in Examples 4 and 5.

Polyethylene terephthalate having a limiting viscosity of 0.53 containing 0.1% by weight of magnesium stearate as a lubricant was melt spun from a spinning nozzle corresponding to 20 holes×0.5 mm diameter and having a cross-section which had expanded portions at respective top edges of projections extended in three directions from a central connecting portion as shown in FIG. 4, into a spinning tube with a melt extruder. The spinning was conducted at a spinning temperature of 270° to 285° C. and a drawing speed of 100 m/min. The fibers thus obtained were then stretched 2 times in hot water at 75° C., stretched 2.5 times in hot water at 85° C., and heat treated with heater roll at 140° C. The fiber thus obtained had a cross-section comprising one central connecting portion and projections extended in three directions from the central connecting portion, wherein at least one of the three projections was most narrowed at a portion where it was nearer from the top edge of the projection than ½ of a length of from a center of the central connecting portion to the top edge of the projection. Fineness of single yarn of the fiber was 35 d. Dimensions of the cross-section of the fiber are shown in the Table below.

Further, functional evaluations were performed on the bulkiness and soft feeling as the braid in the same manner as in Example 1.

The results obtained are shown in the Table below.

EXAMPLE 5

Polypropylene (MI(melt index according to JIS K7210) =10 g/10 min) was melt spun from a spinning nozzle corresponding to 20 holes×0.5 mm diameter and having a cross-section shown in FIG. 4 into a spinning tube with a melt extruder. The spinning temperature was 240° to 265° C., and a drawing speed was 100 m/min. The fiber thus obtained was further stretched 4 times. The fiber thus obtained had a cross-section comprising one central connecting portion and projections extended in three directions from the central connecting portion, wherein at least one of the three projections was most narrowed at a portion where it was nearer from the top edge of the projection than ½ of a length from a center of the central connecting portion to the top edge of the projection. Fineness of the single yarn of the fiber was 40 d. Dimensions of the cross-section of the fiber are shown in the Table below.

Further, functional evaluations were performed on the bulkiness and the soft feeling as the braid in the same manner as in Example 1.

The results obtained are shown in the Table below.

TABLE

| | Shape of Cross-section of Fiber | Fineness | Dimensions of Cross-section | | | | Braid Evaluation | |
|---|---|---|---|---|---|---|---|---|
| | | | W1/W2 | R/W1 | W1max/W1min | Rmax/Rmin | Bulkiness | Soft feeling |
| Example 1 | Approximately Y shape | 32d | 1.13 | 3.1 | 1.55 | 1.27 | ⊙ | ⊙ |
| Comparative Example 2 | Approximately Y shape | 45d | 1.01 | 2.3 | 1.43 | 1.27 | Δ - ○ | Δ |
| Example 2 | Approximately Y shape | 32d | 1.23 | 3.8 | 1.32 | 1.26 | ⊙ | ○ |
| Example 3 | Approximatley Y shape | 32d | 1.40 | 4.6 | 1.53 | 1.20 | ○ | ○ |
| Comparative Example 2 | Flatten shape | 32d | — | — | — | — | × | ⊙ |
| Example 4 | Approximately Y shape | 35d | 1.50 | 3.5 | 1.10 | 1.07 | ○ | ○ |
| Example 5 | Approximately Y shape | 40d | 1.42 | 2.5 | 1.70 | 1.40 | ⊙ | ○ |

Evaluation method and evaluation standard

Bulkiness

Method: According to appearance

Standard:

⊙: Very excellent o: Excellent

Δ: Slightly poor x: Poor

Soft Feeling

Method: According to functional test

Standard

⊙: Very excellent o: Excellent

Δ: Slightly poor x: Poor

As is apparent from the results shown in the Table above, the use of fiber having the cross-section as defined according to the present invention can provide the fiber for artificial hair having an excellent bulkiness and a soft feeling.

What is claimed is:

1. Modified cross-section fiber for artificial hair, comprising synthetic fiber, said synthetic fiber having a cross-section comprising one central connecting portion and projections extended in three directions from the central connecting portion, wherein at least one of the three projections is most narrowed at a portion where it is nearer from a top edge of the projection than ½ of a length R from a center of the central connecting portion to the top edge of the projection, a ratio of W1/W2 wherein W1 is a width of the widest portion in the portion where it is nearer from the top edge than the most narrowed portion, and W2 is a width of the most narrowed portion is from 1.05 to 2.0, and a ratio of R/W1 wherein R and W1 are the same as defined above is from 1.10 to 5.0.

2. The modified cross-section fibers for the artificial hair as claimed in claim 1, wherein at least two of three projections are most narrowed at portions where they are nearer from the top edges of the projections than the length R, a ratio of W1 max/W1 min wherein W1 max is the maximum value of a width W1 of the widest portion in the portion where it is nearer from the top edge of the projection than the most narrowed portion, and W1 min is the minimum value of a width W1 of the widest portion in the portion where it is nearer from the top edge of the projection than the most narrowed portion is from 1.05 to 1.7, and a ratio of R max/R min wherein R max is the maximum value of a length R of from the center of the connecting portion to the top edge of each projection, and R min is the minimum value of a length R of from the center of the central connecting portion to the top edge of each projection is from 1.05 to 1.5.

3. The modified cross-section fibers for the artificial hair as claimed claim 1 or 2, wherein the synthetic fiber has a single yarn fineness of from 25 to 75 denier.

4. The modified cross-section fibers for the artificial hair as claimed in claims 1 or 2, wherein the synthetic fiber is for decoration of hair on the head.

5. The modified cross-section fibers for the artificial hair as claimed in claim 4, wherein the decoration for hair on the head is a braid or a extension hair.

6. A fiber bundle for head decoration comprising a fiber bundle obtained by subjecting the fibers as claimed in claims 1 or 2 to crimping so as to have 5 to 15 wavy shapes as a repeating unit of a crest and a root in a linear distance of 100 mm, and a total length of the height of the crest and the depth of the root being from 5 to 12 mm.

* * * * *